US010347124B1

(12) United States Patent
Grossberg

(10) Patent No.: US 10,347,124 B1
(45) Date of Patent: Jul. 9, 2019

(54) TRAFFIC LIGHT ENHANCEMENT DEVICE AND METHOD

(71) Applicant: Meir Grossberg, Agoura Hills, CA (US)

(72) Inventor: Meir Grossberg, Agoura Hills, CA (US)

( * ) Notice: Subject to any disclaimer, the term of this patent is extended or adjusted under 35 U.S.C. 154(b) by 439 days.

(21) Appl. No.: 15/153,964

(22) Filed: May 13, 2016

(51) Int. Cl.
*G08G 1/096* (2006.01)
*G08G 1/095* (2006.01)

(52) U.S. Cl.
CPC ..... *G08G 1/096* (2013.01); *G08G 1/095* (2013.01)

(58) Field of Classification Search
CPC ..... G08G 1/00; G06Q 10/00
See application file for complete search history.

(56) References Cited

U.S. PATENT DOCUMENTS 9,064,411 B1 * 6/2015 Patton, Jr. ..... G08G 1/096
2007/0176791 A1 * 8/2007 Bolotin ..... G08G 1/096 340/929
2010/0259419 A1 * 10/2010 Renner ..... G08G 1/096 340/929

* cited by examiner

*Primary Examiner* — Shirley Lu
(74) *Attorney, Agent, or Firm* — Colin P. Abrahams

(57) ABSTRACT

A traffic light enhancement device for a traffic light comprises a light bulb having a color which is present in the traffic light for installation at the traffic light to replace an existing lightbulb of corresponding color in the traffic light. A processor is provided and associated with the lightbulb for measuring the duration for which the color is illuminated in the normal operation of the traffic light. A lightbulb display is provided in the light bulb for displaying the color based on processor measurements in changing configurations according to remaining duration for which the color is illuminated.

24 Claims, 17 Drawing Sheets

Notes:
1. Flow enter from top
2. Flow exit from bottom or side

A

B

TRAFFIC LIGHT ENHANCEMENT DEVICE AND METHOD

FIELD AND BACKGROUND OF THE INVENTION

This invention relates to a traffic light enhancement device and method, as well as a method for alerting and providing information to traffic approaching a traffic light. More particularly, the invention is for a device and method which is designed to provide motorists and others with more information relating to a traffic light, including indicators and controls relating to the condition of a traffic light, and timing regarding future changes of the condition of the traffic light.

Traffic lights are a feature of every day life, controlling roadways and intersections to facilitate and moderate the flow of traffic. In an era of increasing use of cars and other vehicles, heavy traffic flow has become the norm in just about every part of the world, and the control of such traffic in a safe and efficient manner is more critical than ever. Traffic lights play a major role in this regard, allowing traffic to move sequentially and selectively in cycles, while stopping other traffic, so as to ensure careful and safe movement of traffic within the intersection. As is well known, traffic lights help to achieve this objective by basically using three color lights. The red light directs the traffic facing it to stop, the green light directs the traffic facing it to proceed, while a yellow or amber light is most often utilized to warn moving traffic that a green light will soon be turning to a red light, and that appropriate precautions should be made to either stop the vehicle, or to ensure that the vehicle has cleared the intersection before the red light is activated.

As noted above, roadways and intersections have become more and more complex over time to deal with increased traffic and vehicles, and the concomitant with this development has been increasing complexity with respect to the nature and operation of traffic lights. Particularly, many traffic lights, especially in areas of heavier or faster moving vehicles, now feature the protected turn, where a green arrow gives the right-of-way to vehicles turning at an intersection, while stopping other vehicles whose right-of-way may otherwise create a dangerous condition.

Other forms of traffic light include pedestrian control which allows pedestrians to cross roads and intersections more safely, to avoid injuries and harm. These pedestrian traffic lights, as well as other non-pedestrian traffic lights, have more recently become associated with timers, which may, for example, count down the time remaining from the current green light phase to the point where the traffic light will turn red. These count downs provide additional information to motorists and pedestrians, who are therefore able to hopefully make better driving decisions by utilizing this information.

SUMMARY OF THE INVENTION

According to one aspect of the invention, there is provided a traffic light enhancement device for a traffic light comprising: a light bulb having a color which is present in the traffic light for installation at the traffic light to replace an existing lightbulb of corresponding color in the traffic light; a processor associated with the lightbulb for measuring the duration for which the color is illuminated in the normal operation of the traffic light; and a lightbulb display in the light bulb for displaying the color based on processor measurements in changing configurations according to remaining duration for which the color is illuminated.

In one embodiment, the lightbulb may selectively show two or more such colors. Further, the device may comprise a self-contained modular unit for replacing the existing lightbulb.

Preferably, the processor continuously measures the duration for which the color is illuminated when the lightbulb has been installed, and may adapt the changing configurations based on changes in duration for which the color is illuminated.

In a preferred embodiment, the lightbulb display comprises a first indicator phase followed by a second indicator phase, the first and second indicator phases having a duration equivalent to the duration for which the color is illuminated. The first indicator phase may comprise a bar which rotates within the lightbulb display. The second indicator phase may comprise a second by second decrement countdown from a selected number to zero, wherein zero represents a conclusion of the duration for which the color is illuminated.

In one embodiment, a plurality of existing light bulbs for the traffic light are replaced. The processor may operate to illuminate the lightbulb display in different configurations and durations depending upon day and time of day, or depending upon traffic flow conditions.

According to a further aspect of the invention, there is provided a method of enhancing a traffic light comprising: installing a light bulb having a color which is present in the traffic light at the traffic light to replace an existing lightbulb of corresponding color in the traffic light;

measuring the duration for which the color is illuminated in the normal operation of the traffic light; and displaying in the light bulb the color in changing configurations based on processor measurements according to remaining duration for which the color is illuminated.

According to yet a further aspect of the invention, there is provided a traffic light system comprising a plurality synchronized traffic lights for controlling traffic at an intersection, each traffic light having a plurality of existing red, yellow and green light bulbs, wherein one or more of the existing light bulbs are replaced with a traffic light enhancement device set forth above.

One important aspect of the present invention is to provide an enhanced traffic light which provides more information to motorists and road users so that driving decisions, and the decisions of pedestrians to cross roads or intersections, can be made with a greater comfort level that the correct and safe decision is being made.

The invention therefore relates to a traffic light enhancement device and method which may be incorporated into an existing traffic light, to provide more information relating to the timing of the yellow and green phases. An important feature of the traffic light enhancement in accordance with the present invention is its ability to be installed at a particular traffic light, to "learn" the patterns and phases of the traffic light, and to provide additional information relating to phases from the learned information. Therefore, one feature of the invention allows that it be installed and incorporated into an existing set of traffic lights without the need for major or other hardware additions or software programming changes. In one preferred form, the traffic light enhancement device may be modular in nature, so that it may simply be installed to replace an existing device, and derive the power needed to operate it from the system in which it is installed.

In one aspect, a traffic light enhancement device in accordance with the present invention may be installed and incorporated into an existing traffic light control system at a given intersection or traffic location. The traffic light enhancement device, once installed, will measure, monitor and record the phases at that particular traffic light, noting, for example, the length and configuration of each of the red, yellow and/or green phases respectively. Once the device of the invention has recorded and "learned" these parameters, the device can also enhance any particular traffic light phase by providing additional information. As an example, the traffic enhancement device of the invention may learn that a particular green signal is given, and that the green signal remains for 15 seconds. The traffic light prior to installation of the traffic light enhancement device may, therefore, simply show a solid green light for the full 15 seconds. However, the traffic light enhancement device may alter the solid green light for the full 15 seconds by providing a green light which incorporates further information and displays over all or some of the 15 second phase. In one example, the green light may remain solid or have a rotating arm for five seconds, and thereafter include a second by second breakdown for the remaining 10 seconds, changing numbers which count down from, for example, 9 all the way to one or zero, upon which the green light will switch off, and the yellow light will be activated, as would be conventional at a traffic light. In this example, the traffic light enhancement device provides additional information to motorists and users who will now have a much clearer idea of the time remaining on the green light. Driving patterns can therefore be adjusted, such as to maintain the speed with the knowledge that there will be plenty time for the vehicle to clear the intersection, or to start slowing down because the likelihood of clearing the green light is not very good.

Various forms of signals or indicators may be provided to motorists and others in accordance with the invention. In this regard, it should be noted that the green phase may show a green light which includes changing numbers therein corresponding to the amount of seconds remaining before the green phase ends. Alternatively, or additionally, the notification may be in the form of a small rotating arm in the green light, whose speed or position will provide the motorist with information as to the amount of time remaining in the green phase. Preferably, the form of notification in the green light may be selected so that maximum illumination of the light is maintained, without the need to sacrifice much light by providing the necessary information. In this regard, the invention includes the situation, for example, where a countdown number in the green light is dark surrounded by green, or the number itself is illuminated in green with dark surroundings. Different versions may be preferable in different contexts and situations.

The arrow is also a common feature in many traffic light systems, and may be used in accordance with the invention to indicate time left on the arrow. In this regard, the arrow may be shown as a moving arrow, be associated with a countdown display on or about the arrow, or the arrow may be made up of a number of bars or dots, and the number of these bars or dots decrease according to the amount of time that may be left on the arrow. Once more, it is noted that the traffic light enhancement device of the invention would measure from previous occurrences in the cycle exactly how long the arrow, whatever its function or color may be, is active, and base the warning or alert indicated to the motorist concerning the amount of time remaining based on such measurement. Furthermore, the traffic light enhancement device would continue to measure the relevant phases on an ongoing basis in order to ensure that the display configuration is accurate and comports with the actual time for which a particular color is displayed.

Pedestrian figures or signals in the traffic light for the purposes of managing pedestrian traffic at an intersection may also be part of the traffic light enhancement system of the invention. The pedestrian signals may be in the form of the red or green color, signifying "do not walk" and "walk" respectively, animated walking figures, or other conventional or local indicators that may be used. The time remaining for a pedestrian may be appropriately displayed by a countdown on or by the color when the pedestrian has the right of way to walk, or they may be some form of animation on a walking figure which may be part of the system.

In one aspect, an important feature of the invention is the timing length learning. The system of the invention is able to automatically adapt and readapt. It is able to memorize the length of time that the power is on, when it comes on and goes off so that the signal indicators to start the countdown can be displayed. This may be achieved by measuring the different phases and the length of time, and being able to automatically switch from the current plain display in conventional traffic lights to the indicator type display of the invention. An important benefit of the invention is therefore that it is a self-contained unit which can simply replace an existing unit, then measure display times and configure displays in a manner which provides additional useful information.

The invention may also be capable of correction by self error/readapt management, for example, between weekends and weekdays. For example, it may flash zero time available if the power of the traffic light bulb is on and the countdown has expired. Conversely, it may also detect the error if the power of the traffic light bulb is off but the countdown has not yet expired. In such cases, the next time that the power to a bulb comes on, it will reset to the current plain display until another timing detection process has taken place so that the correct indicated display will resume.

A benefit of the invention is the fact that a modular device or substantially standalone device in accordance with the invention may be installed on a traffic light by simply replacing a current light. Thereafter, an indicator light will show and provide information which is self-explanatory by simply enhancing or improving upon what motorists may be familiar with already.

In one aspect, the invention is for a smart or intelligent traffic light bulb which can replace the existing traffic light bulb. Each smart or intelligent replacement lightbulb will operate in terms of duration activated substantially the same way as the lightbulb it replaces, but additionally provide information relating to remaining time that such lightbulb will be powered. Different mechanisms for displaying the information can be selected, as described herein.

Current products include a green circle, yellow circle, green arrow, yellow arrow, walking figure, red circle, and certain combinations of the above. When a current product is replaced, the corresponding traffic lightbulb is changed, but otherwise no hardware changes are required to the current system. The replacement lightbulb is capable of self learning so that it can automatically adapt and readapt to current system timing. As such, no software change to a current system will normally be required.

When a new or replacement bulb in accordance with the invention is placed in a traffic light, the first step is that the replacement bulb will operate the same as the current bulb which has been removed, namely, it will power on and remain on in the same way and for the same duration as the bulb it replaces. However, during the first cycle or several cycles, the replacement bulb in accordance with the invention is adapted to count and memorize the time during which the power was on, preferably in increments of one second. Thereafter, in future cycles, the replacement bulb of the invention will switch from the current plain display to a new display, which may comprise two additional indicators. The first such indicator, which may be selected by the public authority operating the traffic light, provides an animation including a rotating clock handle symbol display, or an animated moving small arrow symbol on a center bar display of an arrow, or an animated walking figure. The second such indicator represents a time countdown for the remaining time that the bulb will continue to be powered. In this regard, there may be an animated countdown with digits or digit symbol displays, a decreasing bar symbol or side thereof, or such other representation indicating time remaining. The invention is not limited by the nature or manner in which indicators are displayed or the countdown may be illuminated.

In all cases, a traffic light enhancement in accordance with the invention may be controlled or varied by the public authority using the device, and be remotely operable by appropriate signaling. This may have the effect of modifying the duration and configuration of the current system and may be achieved by, for example, using two consecutive short power off signals to program and save a new modification. In this way, future modifications may be easily effected without the need to remove and/or reinstall into the system. Modifications may also be made by use of a handheld device, either before or after installation.

Product in accordance with the invention may also be set for different selected built-in modes by the public authority, such as situations where a no right turn on red is desired. In this configuration, it may no longer be necessary for a separate sign indicating that a right turn on red is not permissible at that intersection.

The product in accordance with the invention may have bi-directional serial communication for future replacement by communicating signals through a power line.

The device and methods of the invention improves the ability to alert drivers not familiar with the junction and other features relating thereto. They may eliminate surprising or unexpectedly short green light durations, and potentially reduce anxiety when approaching an intersection on a long green light. The need to stop abruptly may well be reduced, as would be the need to accelerate to clear a junction.

BRIEF DESCRIPTION OF THE DRAWINGS

FIG. 17A shows a front view of such schematic representation including the LED displays, while FIG. 17B shows a rear view of the schematic representation and illustrating certain essential components thereof.

DETAILED DESCRIPTION OF THE INVENTION

The invention relates to a traffic light system, traffic light devices and methods for adapting or enhancing current forms of traffic light configurations in order to provide vehicle drivers and pedestrians with more information as to the status and remaining duration of selected illuminated bulbs within a traffic light system. More particularly, one embodiment of the invention may modify and enhance the green light illumination of a traffic light in a manner such that an approaching vehicle driver would have more precise and detailed information as to any remaining time that the green light bulb will be illuminated. Traffic lights typically use a combination of red, yellow and green lights to control traffic, with the lights being illuminated sequentially and in relation to other lights in the traffic light system at any particular intersection. While the green lightbulb is the one that is primarily addressed in this invention so as to provide more information as to its status and remaining duration, light bulbs of other colors in a traffic light may similarly benefit from the principles of the invention. Particularly, yellow lights have over the years become more important, and the display of their remaining times for illumination are also an important aspect of the present invention. Further, an enhanced yellow light may be advantageous if the yellow cycle is short, and the junction is not ready for the dynamic green enhancement of the invention. In this way, the yellow countdown is more critical until the junction has been appropriately upgraded.

In the accompanying drawings and figures, sequences of traffic light operation are shown schematically in rectangular blocks. It will be seen that a key is provided, with a solid full circle representing the color green, a solid circle with light stipples representing the color yellow, and a more heavily stippled or grayscale circle representing the color red.

Figure 1:
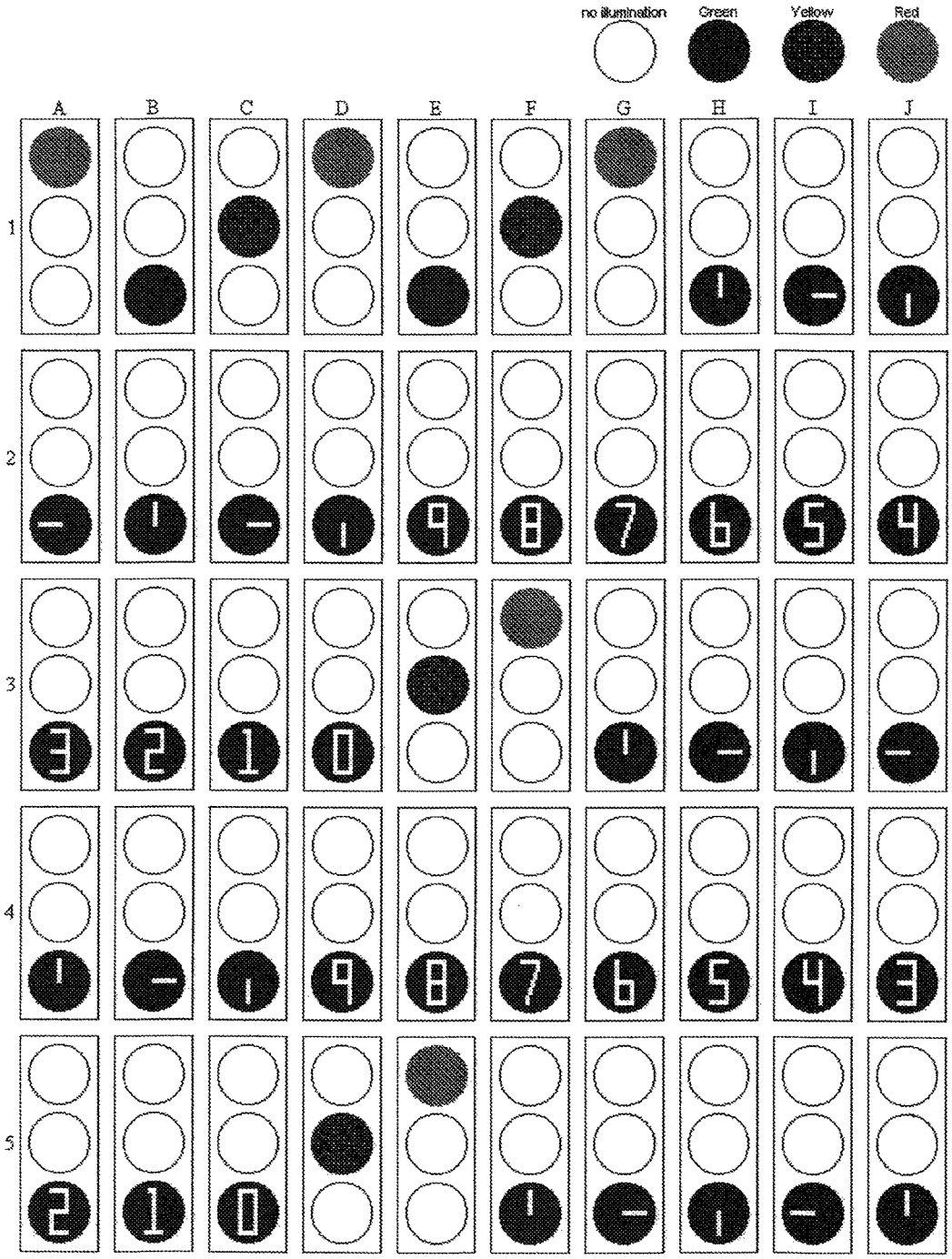
FIG. 1 shows a sequence for a traffic light system in accordance with the present invention.

FIG. 1 of the drawings shows the sequence of a fairly conventional traffic light system which has just been installed with an enhanced green traffic light in accordance with the invention. In box 1A, the light is red, and turns to green in box 1B. After a selected time, the green turns to yellow in box 1C, and back to red in box 1D. (In certain circumstances, the yellow may be omitted, and the change will be from green to red, with the countdown showing accordingly). The enhanced green traffic light measures the time during which the green light is illuminated. The process is repeated in boxes 1D to 1G. At this point, the traffic light system of the invention has established the duration of the green light, and in subsequent changes to green, will show displays which provide more information relating to the duration for which it will remain green.

The light turns green again in box 1H, and a bar, or a clock type handle, representing the hand of a clock is shown in the vertical position. In boxes 1H to 2D, the bar rotates clockwise in quarter circle increments, and this constitutes a first indicator as to the status of the green duration. Nine seconds prior to the end of the green duration, the number "9" appears in the green light, and a second by second countdown is shown in boxes 2E to 3D. In box 3E, the light changes to yellow, and then to red in box 3F. This pattern is repeated, when the light goes through its various phases once more, as shown in boxes 3G to 5J. It will therefore be seen that a traffic light modified with the light enhancement in accordance with the present invention provides further useful information during the green phase. A first indicator arrangement shows a rotating clock like display, indicating that the change away from green is not imminent, while a second indicator arrangement counts down in seconds the amount of time remaining before the green will change to yellow.

Figure 2:
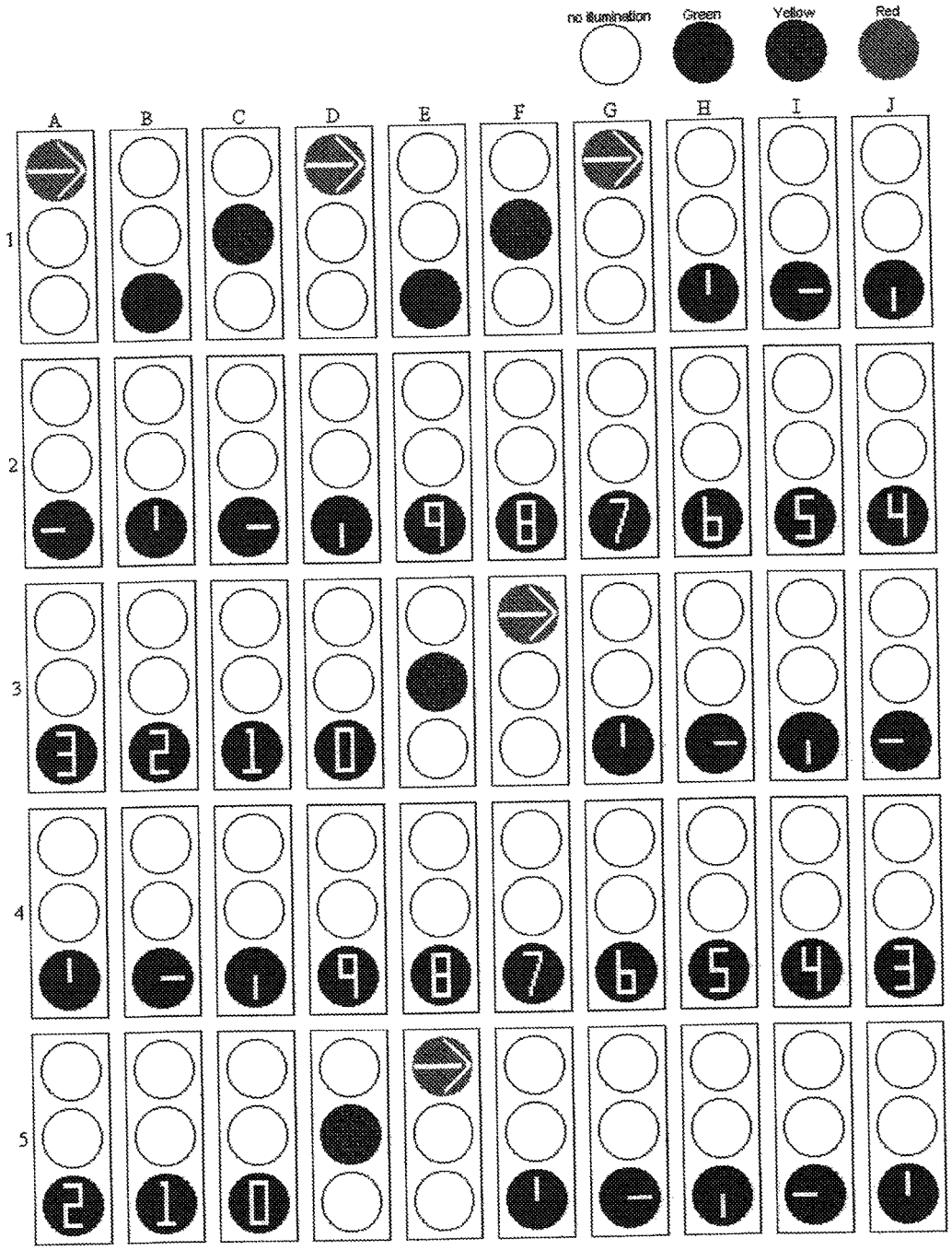
FIG. 2 shows a sequence for a traffic light system in accordance with a further aspect of present invention.

FIG. 2 of the drawings shows another example of the enhanced traffic light of the invention wherein the intersection may not allow a right turn on red. In accordance with the present invention where the current device has been replaced, Box 1A shows the red light illuminated with an arrow pointing to the right, signifying that the turn to the right may not be made during the red illumination phase. In box 1B, the light turns to green, then to yellow in box 1C, and again to red in box 1D. The sequence is repeated in boxes 1D to 1G. In box 1H to 3G, the green light, which includes a traffic light enhancement device in accordance with the present invention which has replaced the current device, goes through its first and second indicator phases, as described above with reference to FIG. 1. The traffic light changes to yellow in box 3E and then to red in box 3F. These patterns are repeated as shown in boxes 3G to 5J.

Figure 3:
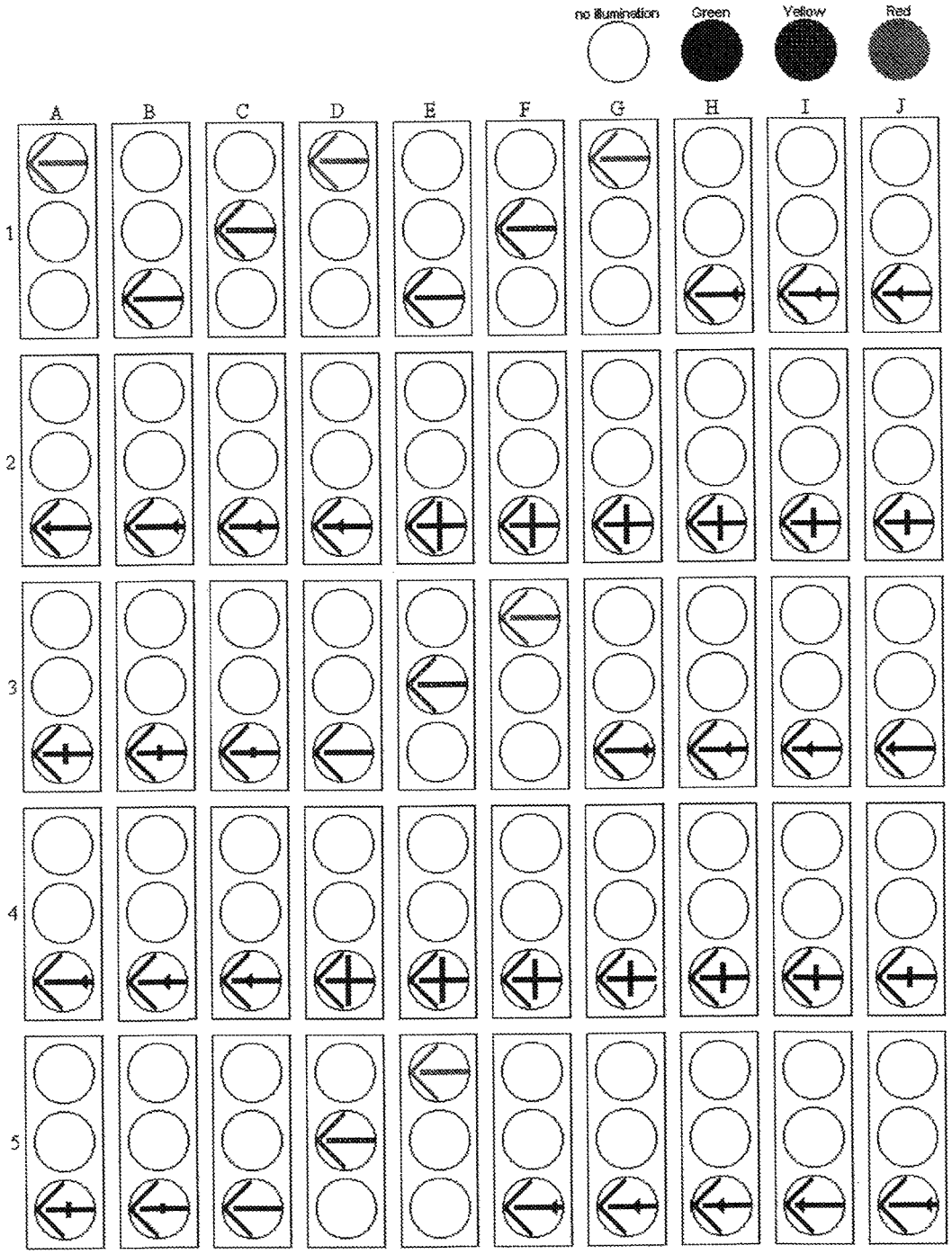
FIG. 3 shows a sequence for a traffic light system in accordance with a further aspect of present invention.

FIG. 3 of the drawings shows a traffic light system where traffic facing this particular light may make a left turn only, or controls those vehicles which may be turning left. The green lightbulb has been replaced with one in accordance with the invention. Boxes 1A to 1G show two current unchanged sequences, in which the light system of the invention learns the timing and duration by measurement as set forth above. In box 1H, the enhanced traffic light display kicks in. In the first indicator sequence, shown in boxes 1H to 2D, the green arrow has a small arrow or other icon which moves from right to left over the bar of the arrow, signifying that a change from green is not imminent. A second indicator sequence is initiated in box 2E and continues to box 3D. In these sequences a long vertical bar is illuminated, and gets shorter from its opposing upper and lower ends respectively towards the center, until it disappears in box 3D. The diminishing size of the vertical bar provides approaching drivers with a time indicator as to how much longer the arrow will remain green. In box 3E, the light changes to yellow, and then to red in box 3F. This pattern is repeated, since it is now learned, as shown in boxes 3F to 5J of this Figure.

Figure 4:
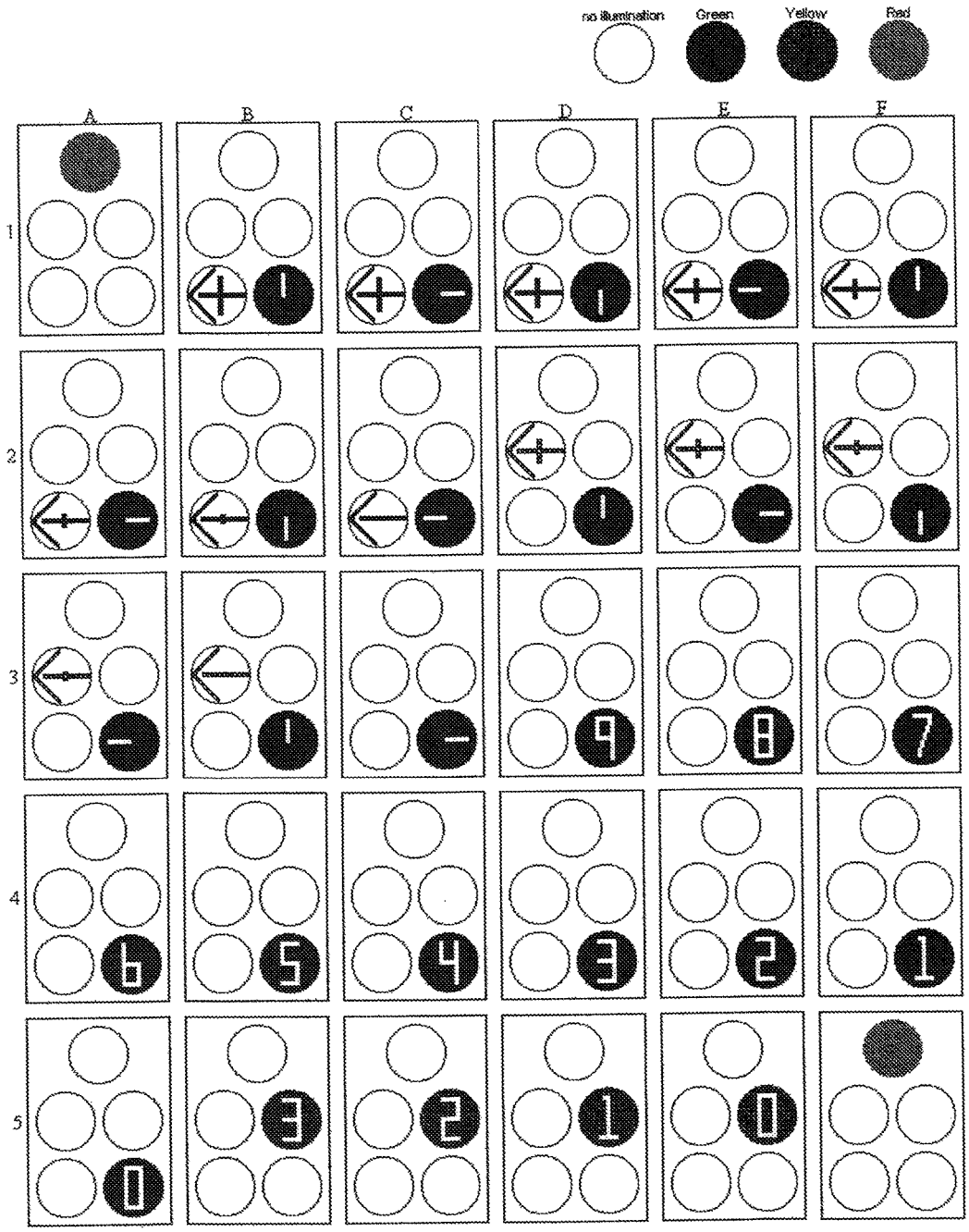
FIG. 4 shows a sequence for a traffic light system in accordance with a further aspect of present invention.

FIG. 4 shows a system of traffic lights for controlling traffic which is turning left as well as traffic which is continuing straight through the intersection. In this figure, there is a single red light at the top, a green and yellow pair on the left for controlling the left turn, and a green and yellow pair on the right for controlling through traffic. Both of the green lights for controlling left turn and through traffic respectively have been configured so as to comprise a traffic light enhancement in accordance with the invention. Further, the yellow light for left turn control has also been so configured. In box 1A, the traffic light is red. In box 1B, both the green lights for the left turn arrow and the through traffic have simultaneously turned to green. In box 1B to 2C, the left turn arrow has a vertical bar, of the type described above, which diminishes in size based on the amount of time remaining. In boxes 2D to 3B, the yellow left turn arrow shows a vertical diminishing bar, and from box 3C, the left turn control is switched off. At the same time, the green light for through traffic follows the first and second indicator pattern as has been described above, as seen in all of the boxes 1B to 5A. In this embodiment, the yellow warning light in boxes 5B to 5E show a countdown in seconds representing time remaining that the yellow light will remain illuminated, and finally, in box 5F, the light turns back to red as originally shown.

Figure 5:
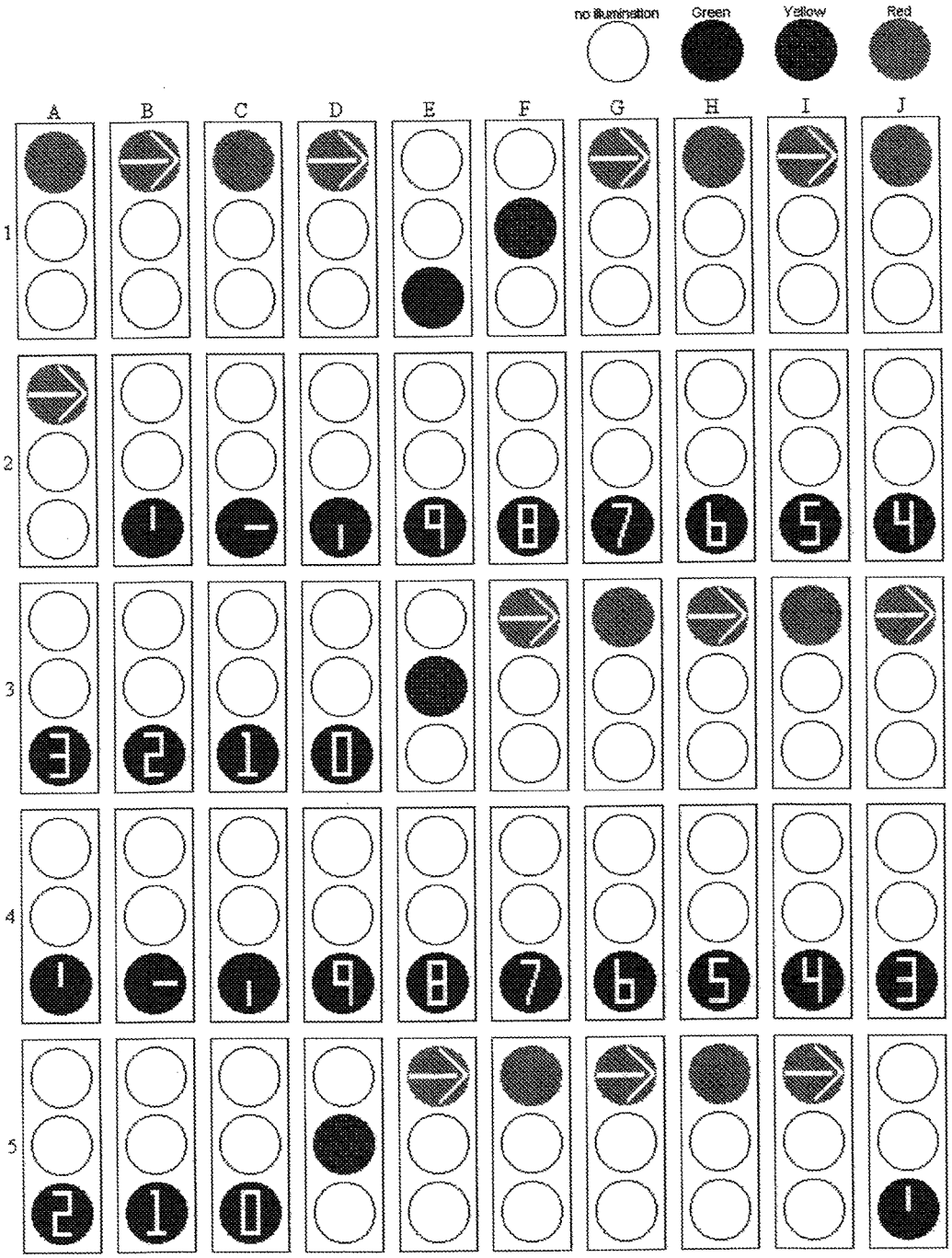
FIG. 5 shows a sequence for a traffic light system in accordance with a further aspect of present invention.

Reference is made to FIG. 5 of the drawings which shows a different (public authority) configuration with the red arrow intermittently appearing in order to communicate that a right turn on red is not permitted. Box 1A to 1D illustrates a red light alternating between the solid display and an arrow display which points to the right. This communicates a no right turn on red instruction to motorists, contrary to the default situation in many localities where this is permitted unless otherwise indicated. In boxes 1E to 2A, the light changes to green, then yellow, then the alternating red with solid and arrow. During these phases, the installed traffic light enhancement device learns the traffic lights phases, including the length of time during which the light shows green. In boxes 2B to 3D, the green light with the various indicators (rotating arm or bar followed by a second decrement countdown) is illustrated, and from box 3E, the light changes to yellow, followed by the red, and then green as described above.

Figure 6:
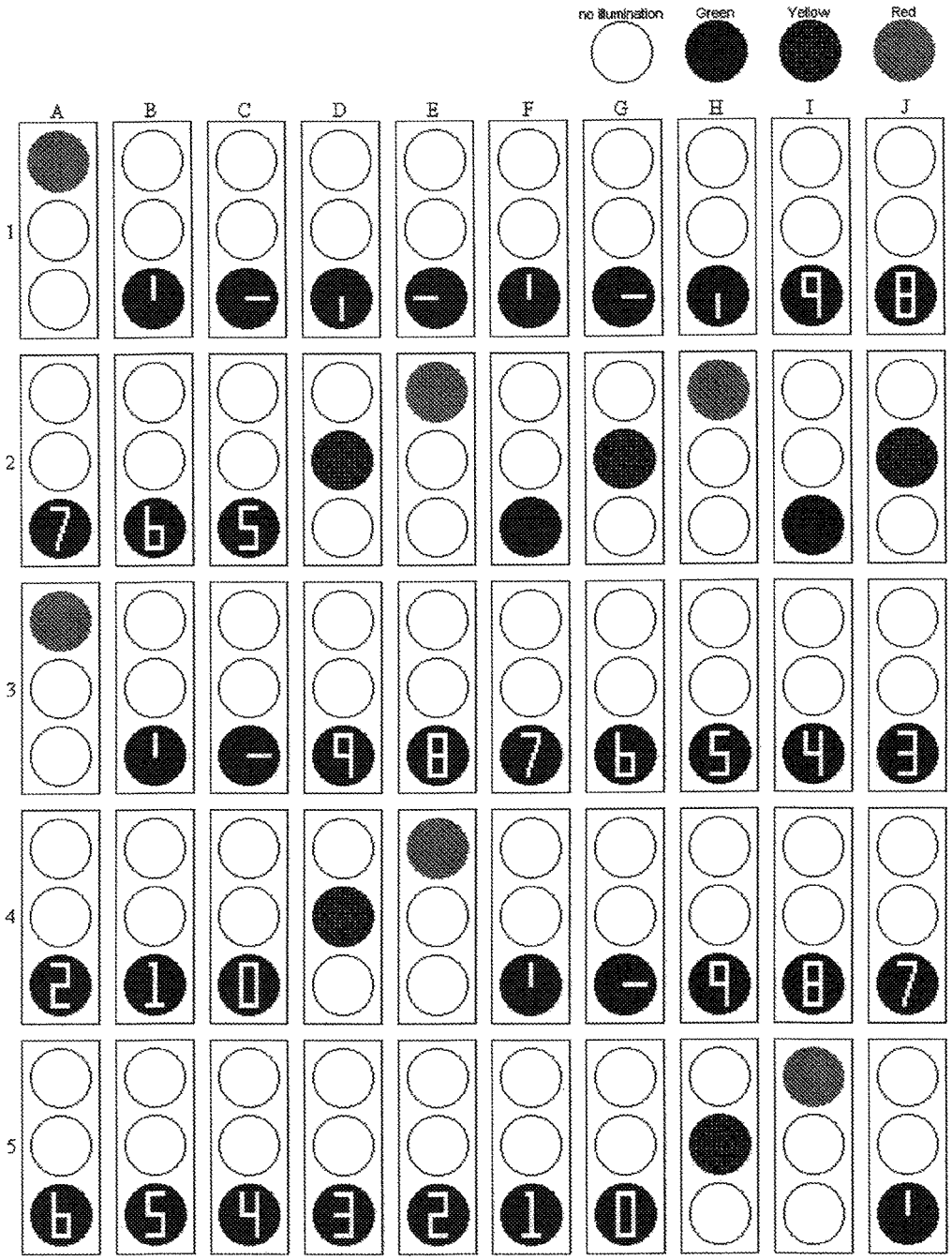
FIG. 6 shows a sequence for a traffic light system in accordance with a further aspect of present invention.

FIG. 6 of the drawings shows a situation where the traffic light enhancement re-adapts itself to a changed phase duration. In box 1B, the traffic light changes to green, with the first indicator showing the rotating arm, followed by the countdown in seconds starting at the nine second mark. However, it will be noted that the light changes to yellow, in box 2D, before the second countdown is complete. The light enhancement device records and monitors the changes in timing as shown in box 2E to 3A, and the green light indicators readapt, as seen in box 3B to 4C. The re-adaption requires the shortening of the first indicator phase with the rotating arm. In other words, the second by second countdown commences sooner in the green light duration than it would have before the re-adaption has occurred, a consequence of the traffic light enhancement device's ability to monitor and react to changes in illumination duration.

Figure 7:
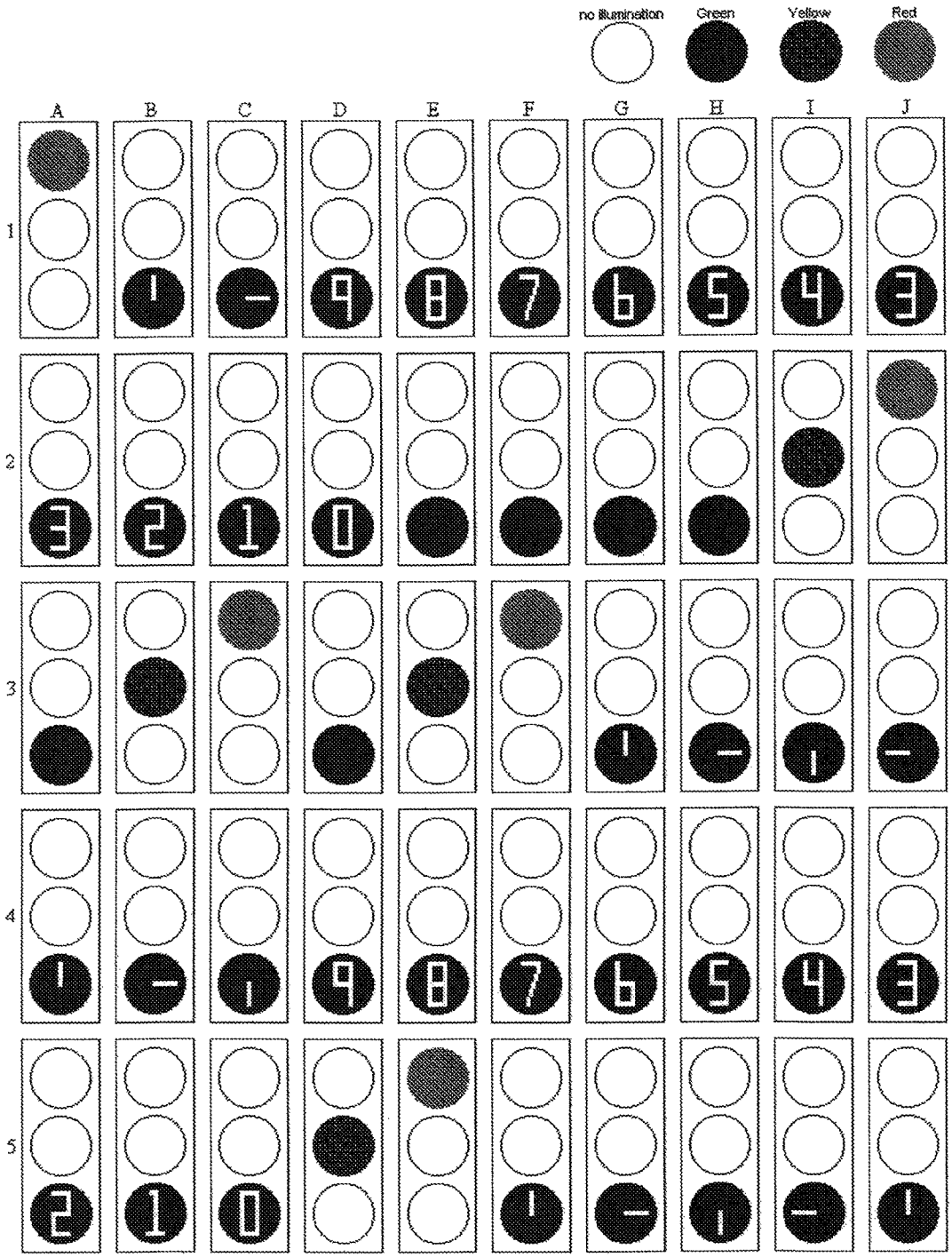
FIG. 7 shows a sequence for a traffic light system in accordance with a further aspect of present invention.

FIG. 7 of the drawings also illustrates a re-adaption situation, somewhat the reverse of the situation illustrated in FIG. 6. As will be seen in this figure, when the second countdown reaches zero, as shown in box 2D, the light remains green, as illustrated in boxes 2E to 2H. The traffic light enhancement device recognizes this change, and adapts in future cycles with a longer first indicator phase as shown in boxes 3G to 4C, so that the second by second countdown reaches zero at the same time that the light changes to yellow.

Figure 8:
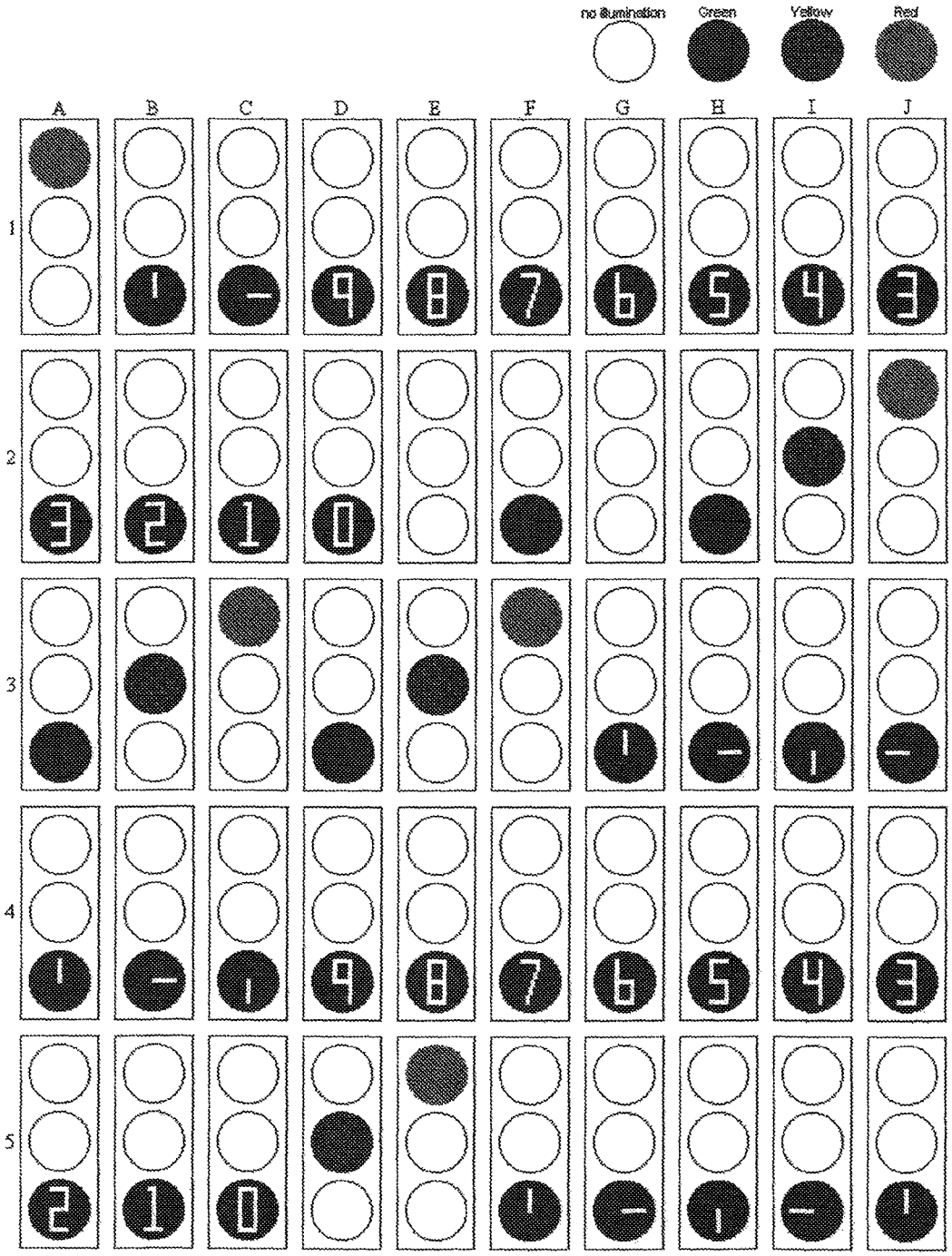
FIG. 8 shows a sequence for a traffic light system in accordance with a further aspect of present invention.

FIG. 8 of the drawings shows a further variation in the ability for re-adaption, where it will be seen that where the second by second countdown reaches zero in box 2D, the green light continues to flash for a while, as illustrated in boxes 2E to 2H. In future phases, the anomaly or correction is learned, and re-adaption takes place so that the countdown to zero corresponds to the length of the green light phase.

Figure 9:
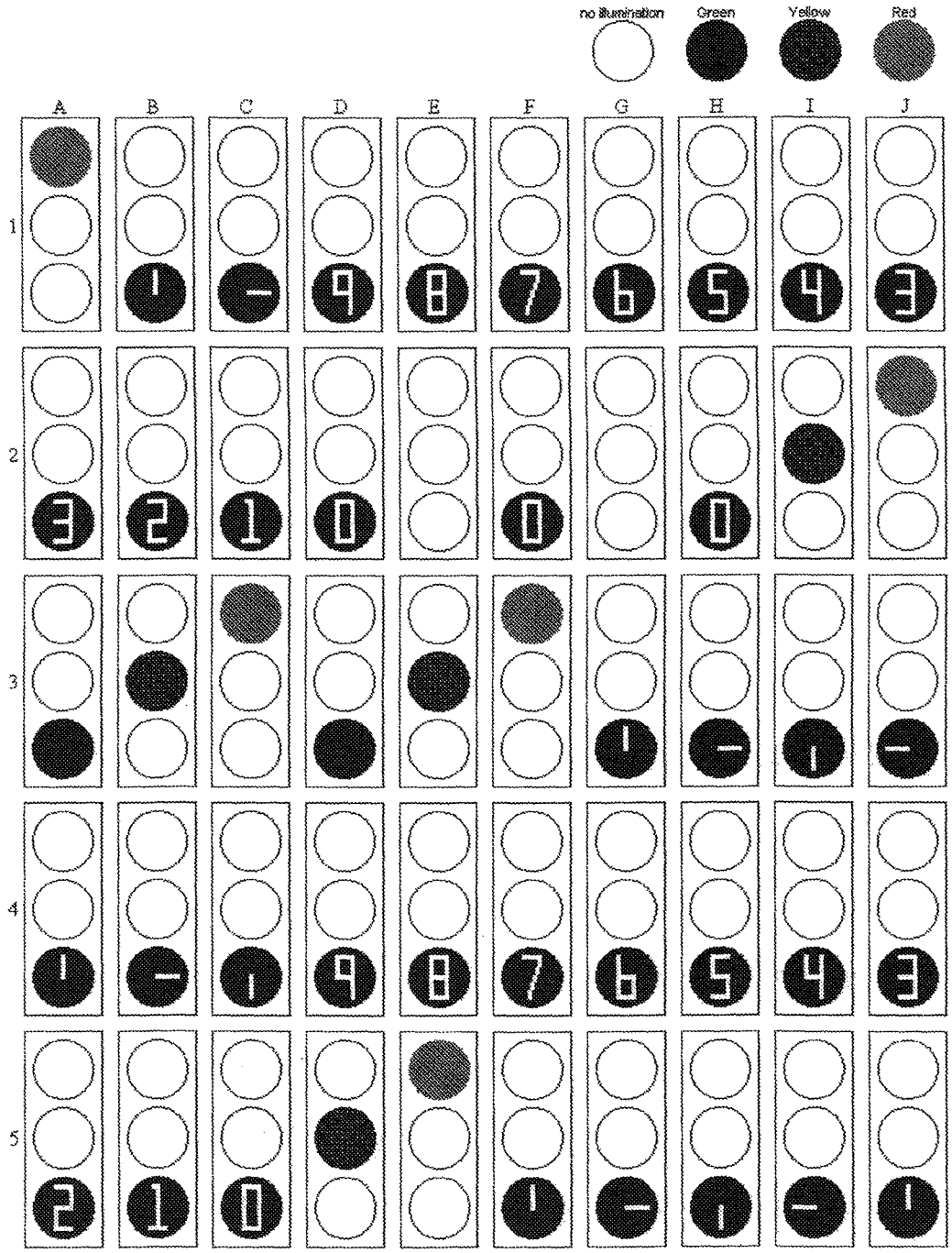
FIG. 9 shows a sequence for a traffic light system in accordance with a further aspect of present invention.

FIG. 9 shows a further re-adaption example where the green illumination continues, as shown in boxes 2E to 2H, in this case showing the number zero in the green light as it flashes. In subsequent phases of the traffic light, the new green duration is monitored and learned, so that a corrected green light illumination with more first indicator rotating bars, as seen in boxes 3G to 4C, appear. Thereafter, the second by second countdown corresponds with the green light duration so that the number zero is shown at the correct time point just before the light turns yellow.

Figure 10:
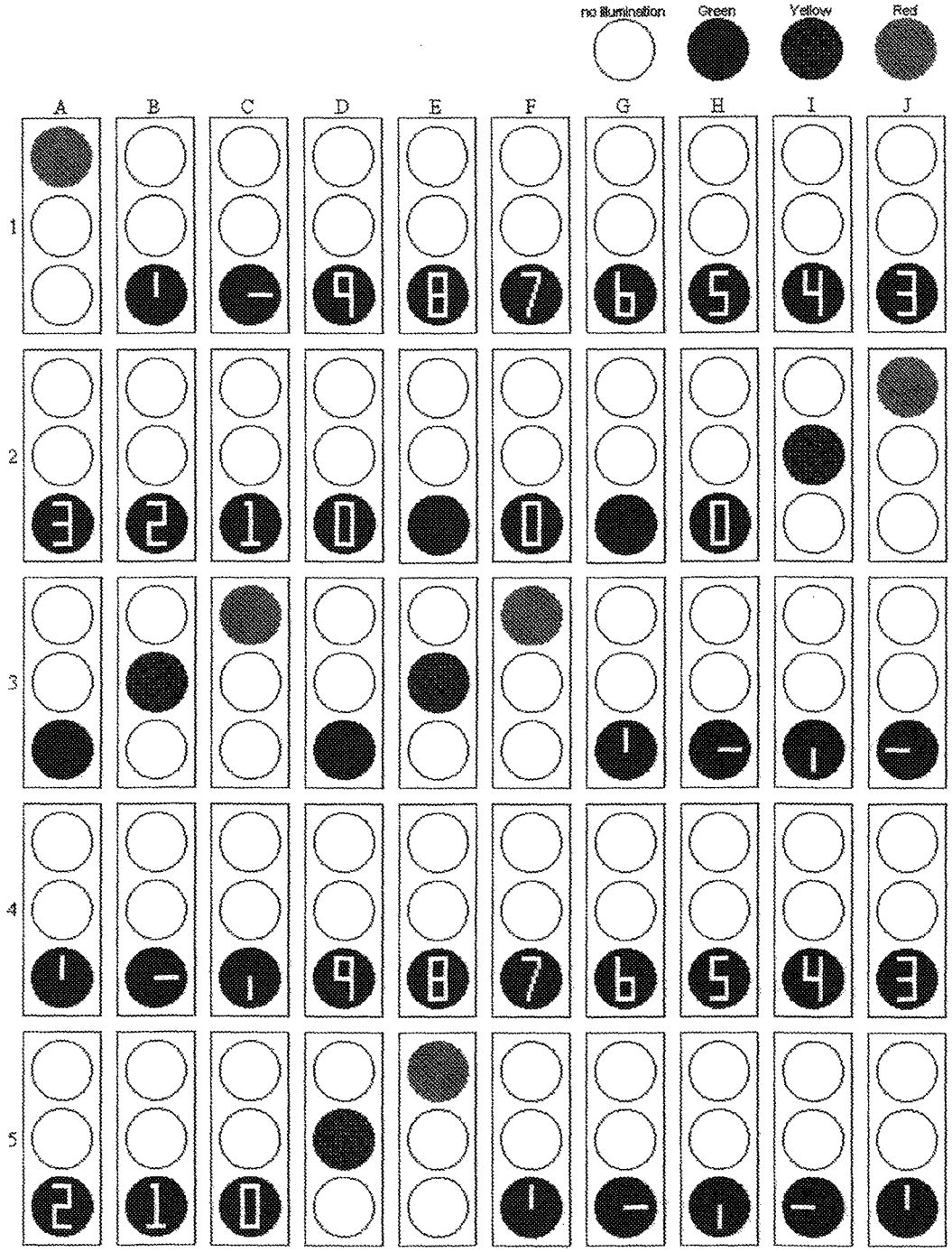
FIG. 10 shows a sequence for a traffic light system in accordance with a further aspect of present invention.

FIG. 10 of the drawings shows a further re-adaption process, similar to that in FIG. 9, but slightly different as shown in boxes 2E to 2H. In this situation, the green light remains illuminated (as opposed to flashing) while the number zero intermittently appears in the green light. In subsequent phases, this anomaly is learned and corrected, and an appropriate countdown in the first indicator and second indicator phases reconfigures itself so as to correspond with the actual duration of the green light.

Figure 11:
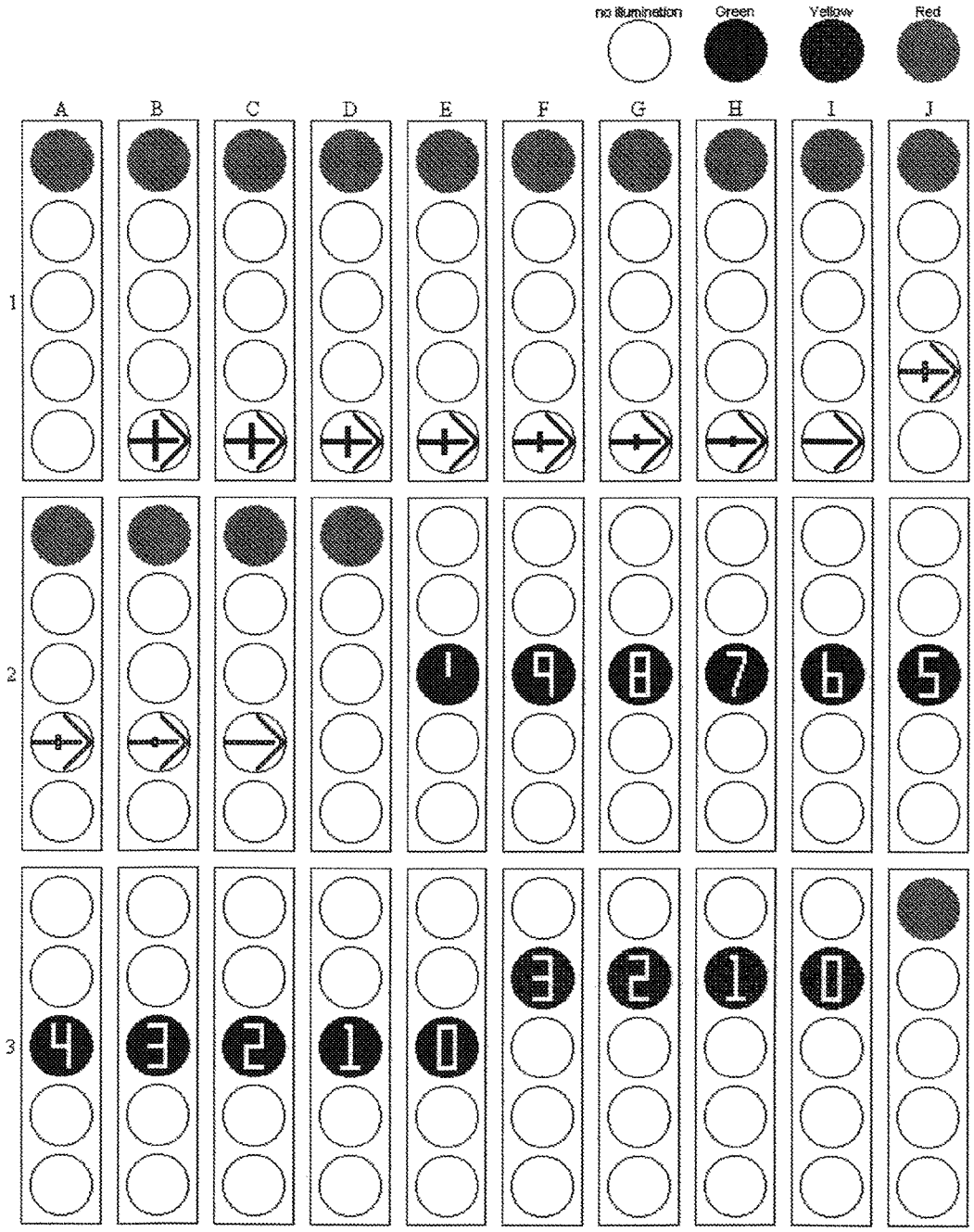
FIG. 11 shows a sequence for a traffic light system in accordance with a further aspect of present invention.

Reference is now made to FIG. 11 of the drawings, which shows a combination of various products, examples of which are described above, adapted to timing. In this example, a red light is shown in combination with a green right turn arrow, wherein the arrow includes a vertical bar which diminishes in size according to the amount of time remaining for the duration of the right turn green arrow. This is shown in box 1B to box 1I. In box 1J to 2C, a right turn yellow light is illuminated, also showing a vertical bar which diminishes in size until it no longer exists, based on the duration of illumination of the yellow arrow. In box 2D, the light is red only, and in boxes 2E to 3E, a green light for through traffic, as well as traffic turning right, is displayed with a short first indicator phase, and a second by second countdown to zero during the second indicator phase. Thereafter, as seen in box 3F to 3I, a three second countdown of the yellow light is displayed, followed by a return to red, as seen in box 3J.

Figure 12:
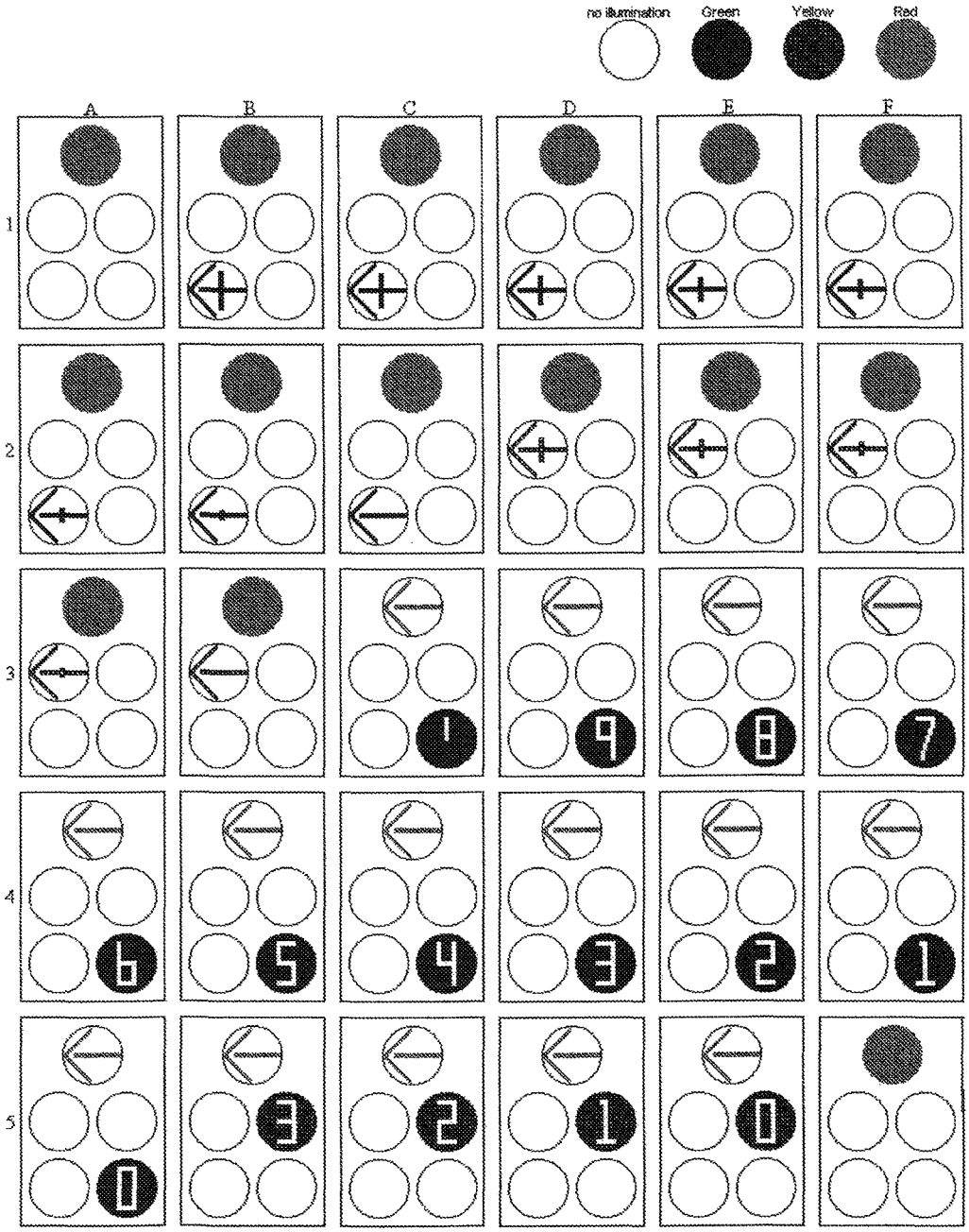
FIG. 12 shows a sequence for a traffic light system in accordance with a further aspect of present invention.

FIG. 12 of the drawings shows a different example of a traffic light enhancement in accordance with the invention, in which a traffic light allows traffic turning left first, and thereafter allows through traffic while stopping left turning traffic. In box 1A, the light is red for all traffic. In boxes 1B to 2C, a green light arrow with a diminishing vertical bar is shown, giving the right-of-way for traffic turning left. In boxes 2D to 3B, a yellow light shows, also with a diminishing vertical bar to indicate amount of time left on the yellow light. In box 3C, traffic turning left is provided a red arrow light, while through traffic receives a green light in the first indicator phase. In the second indicator phase, boxes 3D to 5A, the second by second countdown follows, and the yellow light is then illuminated with a three second countdown, as shown in boxes 5B to 5E. In box 5F, the red light changes from an illuminated left arrow to a solid circle, indicating that all facing traffic must now stop. The invention facilitates a reduction in junction clutter by incorporating the sign into the signal light. Different configurations of signal may be used at different times of day, or on the weekend versus the weekday. Also facilitated is the possibility of a quick repair of a damage sign.

Figure 13:
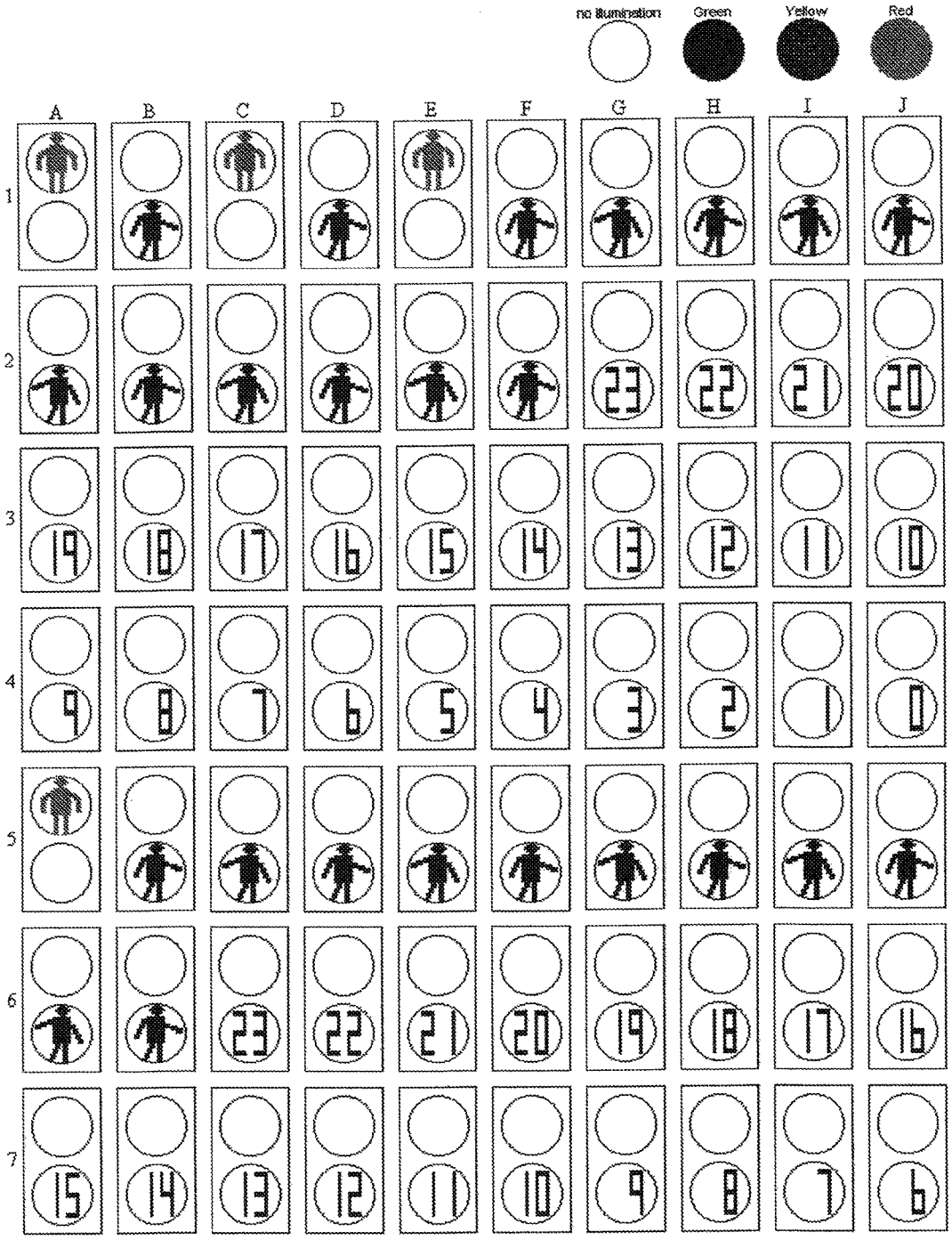
FIG. 13 shows a sequence for a traffic light system in accordance with a further aspect of present invention.

FIG. 13 shows an example where the enhanced traffic light of the invention is used in combination with a pedestrian cross signal. In boxes 1A to 1D, the installed traffic light enhancement device times and learns the phases of the pedestrian light. In boxes 1F to 4J, first and second indicator phases are shown. The first indicator phase is illustrated in box 1F to box 2F, which shows a green person animation with alternating arm positions to indicate permission to cross. In boxes 2G to 4J, the second indicator phase shows a second by second countdown from 23 seconds through zero seconds. The light then turns red, as shown in box 5A. Boxes 5B to 7J show repeats of this phase.

Figure 14:
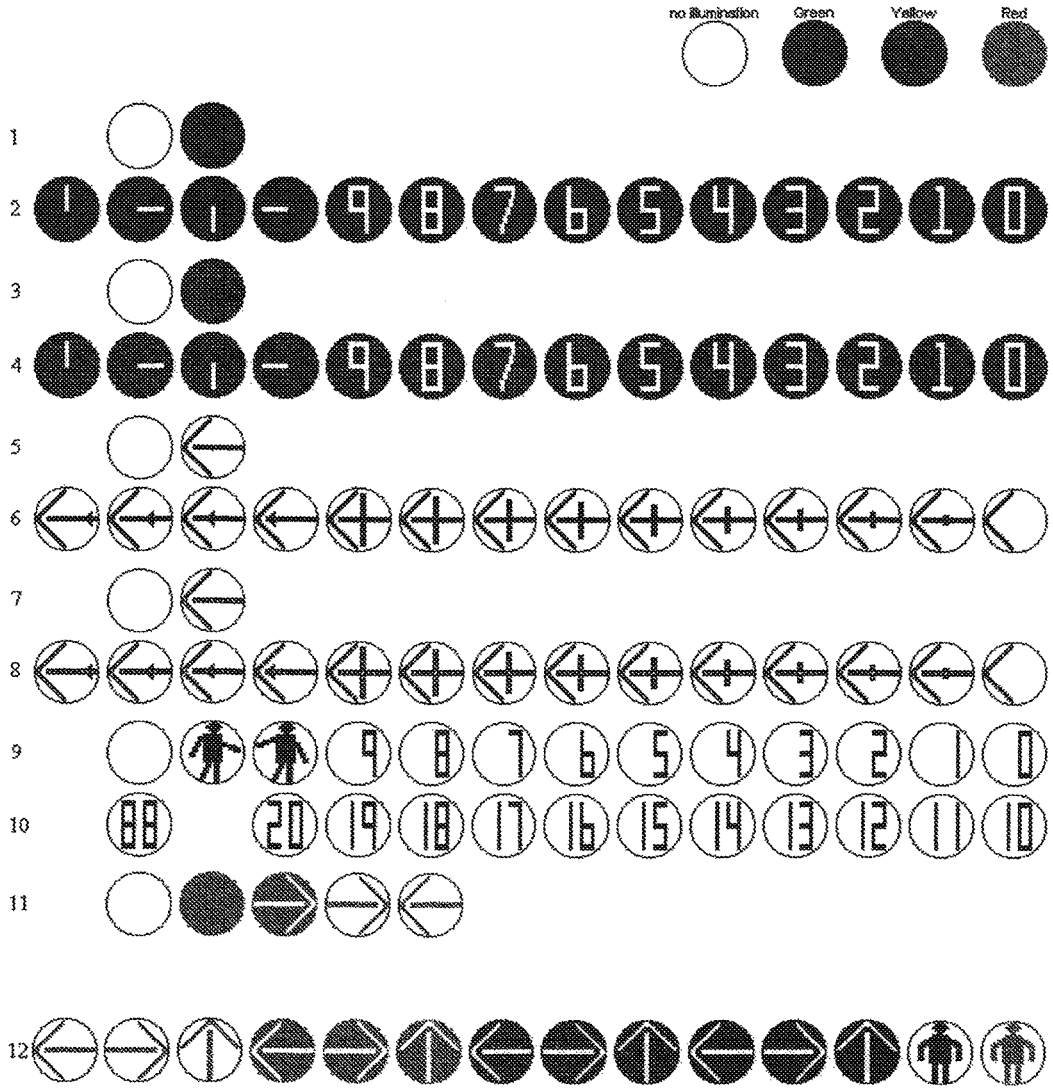
FIG. 14 shows a sequence of various types of products which may be used in accordance with the present invention.

FIG. 14 of the drawings shows various types of products which may be used in accordance with the invention. In line 1, the conventional green light is illustrated, as being either illuminated or not illuminated, the only options provided. This can be replaced by a product illustrated in line 2, where the green illumination in accordance with the invention includes the rotating bar, followed by the second by second countdown. In line 3, a conventional yellow light is shown with the ability to be illuminated or not illuminated, once more the only options provided. In line 4, a yellow traffic light enhancement of the invention is shown, where the yellow light is able to display the rotating bar and countdown numbers which it has learned.

In line 5, a conventional left turn green arrow is shown, which can either be illuminated or not. In line 6, a traffic light enhancement of the invention is shown where the left turn green as the two indicator phases, the first showing a moving arrow along the horizontal bar, followed by the diminishing vertical bar representing the amount of time that the left turn arrow will remain green. In line 7, a conventional yellow light arrow product is shown, and this may be replaced by a yellow light in accordance with the invention, as seen in line 8, which shows the two indicator phases, the first showing a moving arrow along the horizontal bar, followed by the diminishing vertical bar representing the amount of time that the left turn arrow will remain yellow.

A further product of the invention is shown in line 9, which shows a pedestrian green light, with the ability to illuminate the human figure with alternating up and down arm position movements, followed by a second by second incremental countdown. In line 10, a further variation including the second by second countdown is illustrated as a further example.

In line 11, a further product representing a red light of the invention is shown, whereby the red light may be solid, contain a right turn arrow, constitute a right turn arrow, and constitute a left turn arrow. In line 12, additional modifications and variations are illustrated.

Figure 15:
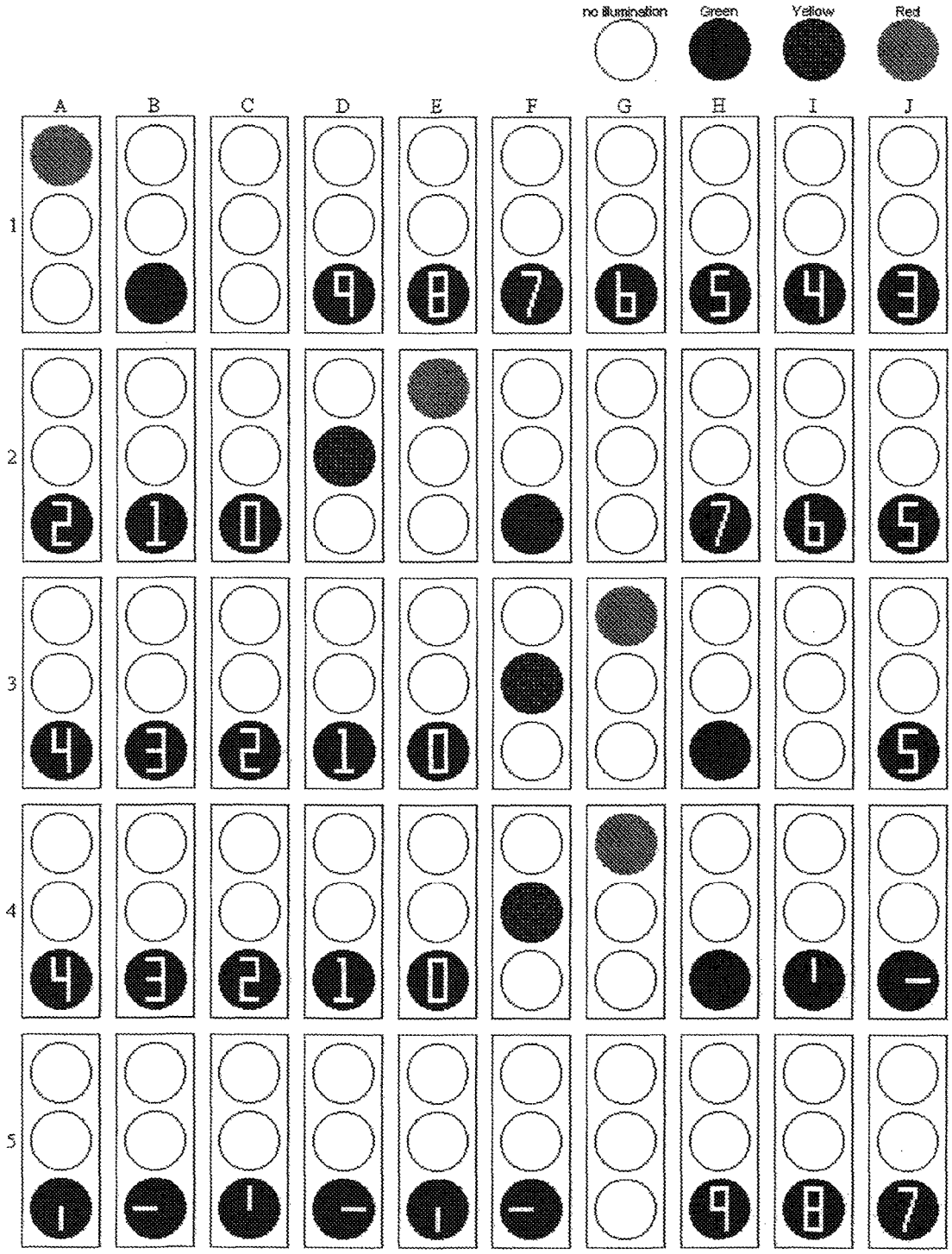
FIG. 15 shows a sequence for a traffic light system in accordance with a further aspect of present invention.

Reference is now made to FIG. 15 of the drawings which shows the operation of a green light with dynamic timing at points 1B, the first illumination after installation, 2F, for example a one second display, and 4H to 5F. These show the green traffic light illumination constant of the invention adapting to an override by a remote signal using a short power off with different pulse width at points 1C, 2G, 3I and 5G indicating remaining time.

Figure 16:
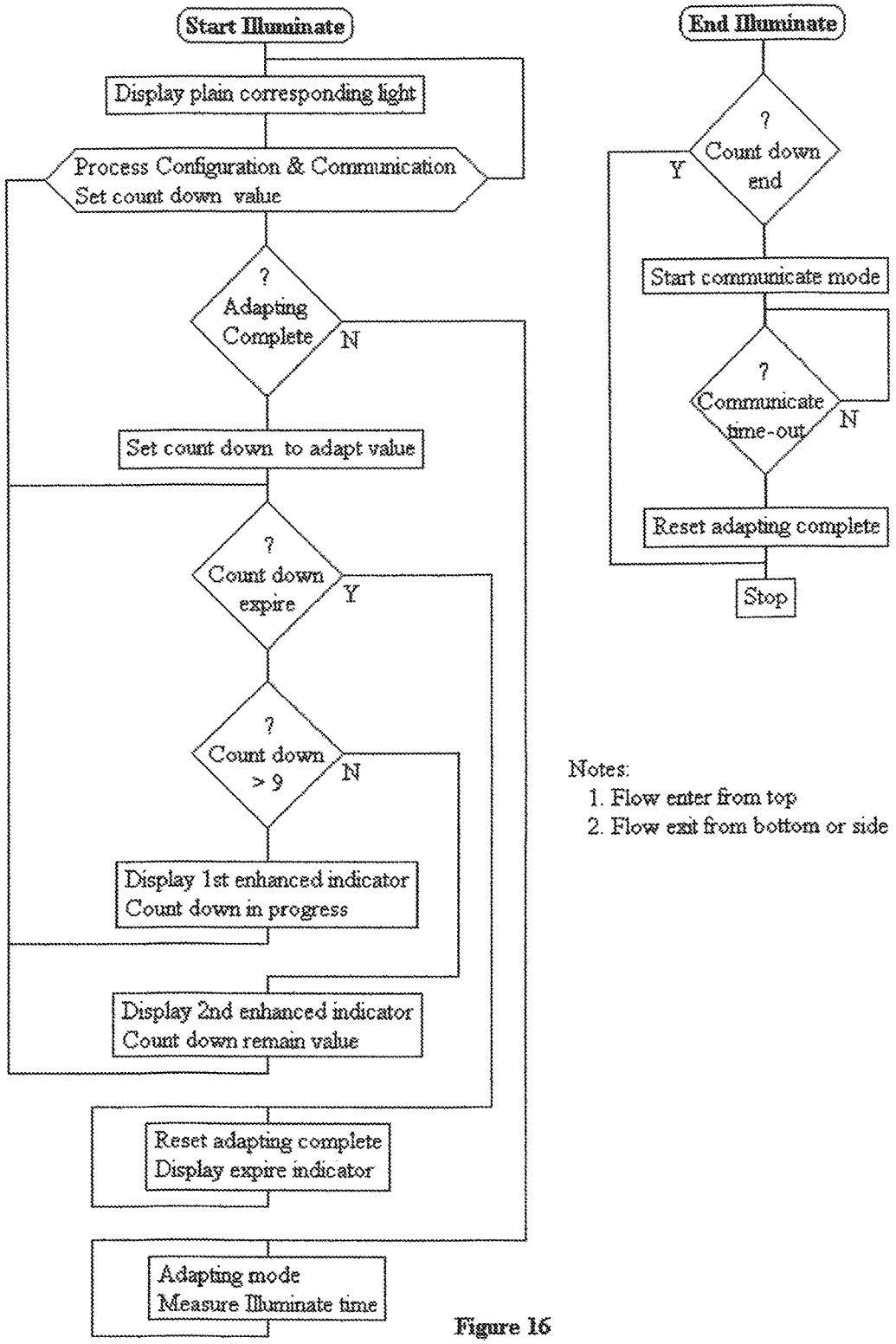
FIG. 16 is a flowchart displaying sequences and options in accordance with embodiments of the present invention.

FIG. 16 illustrates a flow chart showing certain sequences and possibilities of a traffic light enhancement device and system which may be used in accordance with the present invention. The flowchart shows sequences including initial installation where the plain display is shown, subsequently going through a process configuration and communication so that there is an adaption with the enhanced indicator. This figure shows the "start illuminate" sequence, as well as the "end illuminate" sequences which allow reset and re-adapting to take place.

Figure 17:
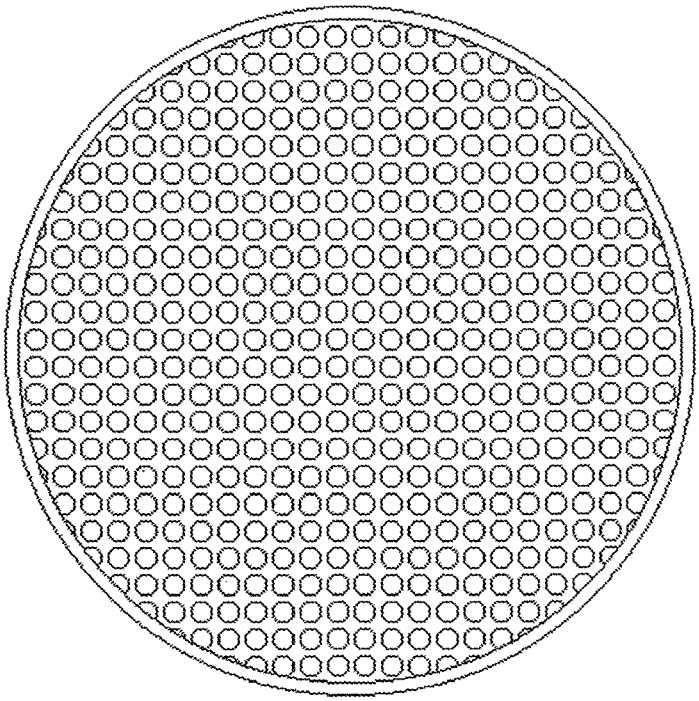
FIG. 17 is a schematic representation of a traffic light enhancement device in accordance with one aspect of the invention.
Figure 17:
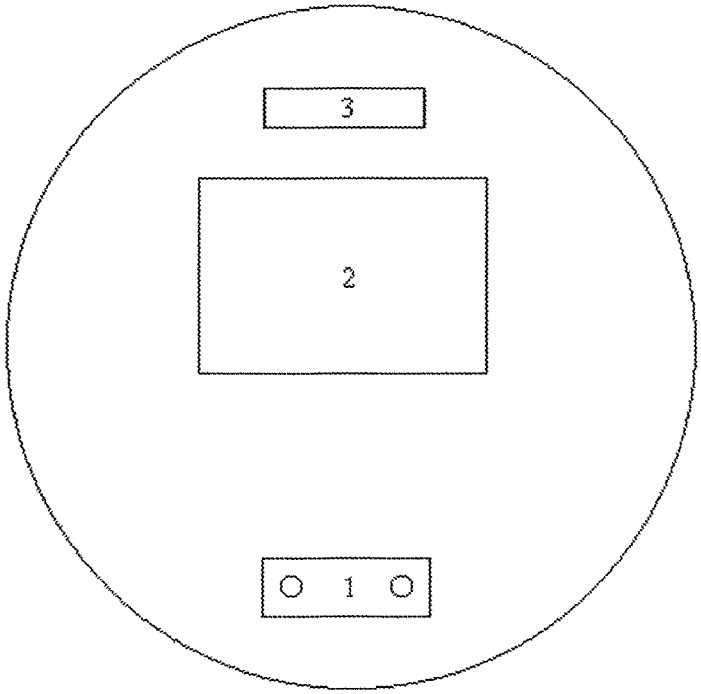

FIG. 17A shows a front view of a traffic light enhancement device, with each small circle representing an LED light. The plurality of LED lights may be illuminated in patterns and configurations which shows the displays as illustrated in the describe sequences above. FIG. 17 B shows a rear view of the traffic light enhancement device, with some of the hardware schematically represented thereon. The reference numeral one represents a connector or plug box which may be used to electrically connect the device with a traffic light system. A processor is illustrated generally at reference 2, while a box 3 may contain jumpers, switches and the like. The number of LEDs can be varied depending upon the desired font and resolution, and the invention is not limited in this regard.

The invention is not limited to the precise details and structures as set forth above. For example, the LED lightbulb may have more than one color so that the countdown marker in the traffic light color (such as green or yellow) may not be an absence of color, but a different color such as white or blue. Also, it may be that a left arrow, for example, is only in use during peak hour traffic or at certain times only. The traffic light enhancement system of the invention monitors any changes so that the countdown takes into account these changes, and can relearn or adapt to the current situation on an ongoing real-time basis.

Further, it is also possible that an intersection or junction may not use a yellow light, and in this case the countdown indicator in the green light will base the countdown on this configuration, so that the countdown in green will continue to display until the red light comes on.

The attached drawings and schematically representative the of the invention, and are not intended to restrict or limit the scope thereof.

Throughout this description, the embodiments and examples shown should be considered as exemplars, rather than limitations on the apparatus and procedures disclosed or claimed. Although many of the examples presented herein involve specific combinations of method acts or system elements, it should be understood that those acts and those elements may be combined in other ways to accomplish the same objectives. Acts, elements and features discussed only in connection with one embodiment are not intended to be excluded from a similar role in other embodiments.

As used herein, "plurality" means two or more. As used herein, a "set" of items may include one or more of such items. As used herein, whether in the written description or the claims, the terms "comprising", "including", "carrying", "having", "containing", "involving", and the like are to be understood to be open-ended, i.e., to mean including but not limited to. Only the transitional phrases "consisting of" and "consisting essentially of", respectively, are closed or semi-closed transitional phrases with respect to claims. Use of ordinal terms such as "first", "second", "third", etc., in the claims to modify a claim element does not by itself connote any priority, precedence, or order of one claim element over another or the temporal order in which acts of a method are performed, but are used merely as labels to distinguish one claim element having a certain name from another element having a same name (but for use of the ordinal term) to distinguish the claim elements. As used herein, "and/or" means that the listed items are alternatives, but the alternatives also include any combination of the listed items.

The invention claimed is:

1. A traffic light enhancement device for a traffic light having at least one existing lightbulb with a power source in the traffic light, the traffic light enhancement device comprising:

a modular, self-contained light bulb assembly with a light bulb and a connector, the light bulb assembly having a light bulb color which is present in the traffic light and for installation at the traffic light to replace the existing lightbulb of corresponding color in the traffic light, the light bulb assembly being connectable at its connector to the power source of the existing lightbulb it is replacing;

a processor associated with the lightbulb assembly for continuously measuring, once installed, the duration for which the color is illuminated in the normal operation of the traffic light; and a lightbulb display portion of the light bulb for displaying the color based on input of continuing processor measurements and communications in changing configurations according to remaining duration for which the color is illuminated.

2. A traffic light enhancement device as claimed in claim 1 wherein the lightbulb has a color selected from one of red, yellow and green.

3. A traffic light enhancement device as claimed in claim 2 wherein the lightbulb may selectively show two or more such colors.

4. A traffic light enhancement device as claimed in claim 1 comprising a self-contained modular unit for replacing the existing lightbulb.

5. A traffic light enhancement device as claimed in claim 1 wherein the processor continuously measures the duration for which the color is illuminated when the lightbulb has been installed.

6. A traffic light enhancement device as claimed in claim 5 wherein the processor adapts the changing configurations based on changes in duration for which the color is illuminated.

7. A traffic light enhancement device as claimed in claim 1 wherein the lightbulb display comprises a first indicator phase followed by a second indicator phase, the first and second indicator phases having a duration equivalent to the duration for which the color is illuminated.

8. A traffic light enhancement device as claimed in claim 7 wherein the first indicator phase comprises a bar which rotates within the lightbulb display.

9. A traffic light enhancement device as claimed in claim 7 wherein the second indicator phase comprises a second by second incremental countdown from a selected number to zero, wherein zero represents a conclusion of the duration for which the color is illuminated.

10. A traffic light enhancement device as claimed in claim 7 wherein the first indicator comprises an arrow having a point portion and an arm portion in the lightbulb display, the arrow having a sequentially illuminated small arrow which moves along an arm portion of the arrow.

11. A traffic light enhancement device as claimed in claim 10 wherein the second indicator comprises an illuminated vertical bar in the lightbulb display, the vertical bar diminishing in length as the remaining duration for which the color is illuminated decreases, and the vertical bar disappears to signify a conclusion of the duration for which the color is illuminated.

12. A traffic light enhancement device as claimed in claim 1 wherein a plurality of existing light bulbs for the traffic light are replaced.

13. A traffic light enhancement device as claimed in claim 12 wherein the lightbulb it replaces is an existing solid color lightbulb and an existing arrow lightbulb.

14. A traffic light enhancement device as claimed in claim 1 wherein the lightbulb display comprises a pedestrian display of a human stick figure.

15. A traffic light enhancement device as claimed in claim 1 wherein the lightbulb display comprises a solid illuminated circle outlining an un-illuminated indicator.

16. A traffic light enhancement device as claimed in claim 1 wherein the lightbulb display comprises an illuminated indicator and an un-illuminated surrounding area.

17. A traffic light enhancement device as claimed in claim 1 wherein the processor can be programmed to illuminate the lightbulb display in different configurations and durations depending upon day and time of day.

18. A traffic light enhancement device as claimed in claim 1 wherein the processor can be programmed to illuminate the lightbulb display in different configurations and durations depending upon traffic flow conditions.

19. A method of enhancing a traffic light having at least one existing light bulb with a power source in the traffic light, the method comprising:

installing a modular, self-contained light bulb assembly with a light bulb and a connector, the light bulb assembly having a light bulb color which is present in the traffic light at the traffic light to replace the existing lightbulb of corresponding color in the traffic light, and connecting the light bulb assembly at its connector to the power source of the existing lightbulb it is replacing;

measuring after installation and on a continuous basis the duration for which the color is illuminated in the normal operation of the traffic light; and displaying in the light bulb the color in changing configurations based on the continuous measurements and communications according to remaining duration for which the color is illuminated.

20. A method as claimed in claim 19 wherein the existing lightbulb is removed and replaced with a modular type lightbulb.

21. A method as claimed in claim 19 wherein a processor is used to measure the duration for which the color is illuminated in the normal operation, as well as to measure the duration for which the color is illuminated thereafter so that the lightbulb display can be adapted and reprogrammed according to any monitored change in the measured duration.

22. A method as claimed in claim 19 wherein the display configurations include a first indicator followed by a second indicator.

23. A method as claimed in claim 22 wherein the first indicator comprises a rotating arm, and the second indicator comprises numerical countdown in seconds to represent the remaining duration for which the color will be illuminated.

24. A traffic light system comprising a plurality synchronized traffic lights for controlling traffic at an intersection, each traffic light having a plurality of existing red, yellow and green light bulbs, wherein one or more of the existing light bulbs are replaced with a traffic light enhancement device as claimed in claim 1.

* * * * *